US012011749B2

(12) United States Patent
Radek et al.

(10) Patent No.: US 12,011,749 B2
(45) Date of Patent: Jun. 18, 2024

(54) ROLL STAND

(71) Applicant: Primetals Technologies Austria GmbH, Linz (AT)

(72) Inventors: Ansgar Radek, Steyregg (AT); Bernhard Schinagl, Ansfelden (AT)

(73) Assignee: Primetals Technologies Austria GmbH, Linz (AT)

( * ) Notice: Subject to any disclaimer, the term of this patent is extended or adjusted under 35 U.S.C. 154(b) by 918 days.

(21) Appl. No.: 17/047,642

(22) PCT Filed: Apr. 25, 2019

(86) PCT No.: PCT/EP2019/060625
§ 371 (c)(1),
(2) Date: Oct. 14, 2020

(87) PCT Pub. No.: WO2019/207050
PCT Pub. Date: Oct. 31, 2019

(65) Prior Publication Data

US 2021/0146413 A1 May 20, 2021

(30) Foreign Application Priority Data

Apr. 27, 2018 (EP) ..... 18169686

(51) Int. Cl.
*B21B 31/07* (2006.01)
*B21B 31/18* (2006.01)

(52) U.S. Cl.
CPC ..... *B21B 31/078* (2013.01); *B21B 31/18* (2013.01); *B21B 2269/14* (2013.01)

(58) Field of Classification Search
CPC ..... B21B 31/078; B21B 31/18; B21B 31/07; B21B 2269/14
See application file for complete search history.

(56) References Cited

U.S. PATENT DOCUMENTS 4,235,485 A 11/1980 Reiter
4,907,329 A 3/1990 Boulot
(Continued)

FOREIGN PATENT DOCUMENTS

CA 2522522 A1 2/2005
CN 1655885 A 8/2005
(Continued)

OTHER PUBLICATIONS

International Search Report and Written Opinion received in PCT/EP2019/060625 dated Jun. 28, 2019, pp. 15.
(Continued)

*Primary Examiner* — Christopher J. Besler
(74) *Attorney, Agent, or Firm* — Liang & Hennessey LLP; Brian Hennessey

(57) ABSTRACT

The invention relates to a roll stand, comprising: a working roll, which is mounted in the roll stand floatingly and for rotation about an axis of rotation extending axially and which has two axially opposite end faces; and at least one bearing assembly, which is arranged on one of the two end faces of the working roll and by means of which the working roll is floatingly supported in the roll stand and which has a housing, in which the working roll is mounted using a fixed bearing. According to the invention, the bearing assembly has a supporting device, by means of which the bearing assembly can be axially supported in the roll stand.

18 Claims, 3 Drawing Sheets

(56) References Cited

U.S. PATENT DOCUMENTS

| | | | | |
|---|---|---|---|---|
| 5,600,987 | A * | 2/1997 | Moritz | B21B 31/07 384/556 |
| 7,377,696 | B2 | 5/2008 | Scheffe et al. | |
| 7,895,871 | B2 | 3/2011 | Zieser et al. | |

FOREIGN PATENT DOCUMENTS

| | | | |
|---|---|---|---|
| CN | 1829575 | A | 9/2006 |
| DE | 941186 | C | 4/1956 |
| DE | 2950773 | A1 | 7/1980 |
| JP | S5594022 | A | 7/1980 |
| JP | S5823507 | A | 2/1983 |
| JP | S58196107 | A | 11/1993 |
| JP | H1080708 | A | 3/1998 |
| JP | 2007533455 | A | 11/2007 |
| WO | 2005011885 | A1 | 2/2005 |

OTHER PUBLICATIONS

European Search Report received in EP18196686.5 dated Oct. 25, 2018, pp. 6.
Japanese Office Action received in 2020-558942 dated Nov. 29, 2021, pp. 6.
Chinese Office Action received in Chinese Application No. 201980028626.4 dated Dec. 2, 2021, pp. 9.
Japanese Notice of Allowance received in Japanese Application No. 2020-558942 dated Nov. 4, 2021, pp. 4.

* cited by examiner

ROLL STAND

CROSS-REFERENCE TO RELATED APPLICATIONS

The present application is a national phase application of PCT Application No. PCT/EP2019/060625, filed Apr. 25, 2019, entitled "ROLL STAND", which claims the benefit of European Patent Application No. 18169686.5, filed Apr. 27, 2018, each of which is incorporated by reference in its entirety.

BACKGROUND OF THE INVENTION

1. Field of the Invention

The invention relates to a roll stand including a working roll and at least one bearing module.

2. Description of the Related Art

In rolling mills, the shaping of rolling stock, e.g. steel, takes place on a roll stand. This shaping is referred to as rolling.

In this context, the rolling of the rolling stock takes place between at least two working rolls (generally referred to below as rolls), which are mounted in the roll stand-in such a way as to be rotatable about their respective axially extending axes of rotation.

Here, the construction of the roll stand depends on the number of rolls, the position of the rolls, the shape of the rolls, the forces acting during rolling and the accuracy requirements of the rolling stock. There are both roll trains with just one roll stand and roll trains with a plurality of roll stands arranged one behind the other or side-by-side.

Particularly for rolling relatively high-strength and high-strength steels, such as steels with strengths of over 500 $N/mm^2$, in particular over 1000 $N/mm^2$, rolls of small diameter, e.g. those with diameters in a range of from 150 mm to 180 mm, are used in such roll stands, said rolls being mounted in a floating manner in the roll stands.

A "floating" bearing assembly (also often referred to as an "overhung" bearing assembly) is taken to mean a bearing assembly for a rotating element—rotating about an axially extending axis of rotation—such as the roll, said assembly having/allowing play in the axial direction (in relation to the axially extending axis of rotation of the rotating element). That is to say that the element (to be provided with floating support) is not fixed in a definite manner in the axial direction. It is thereby possible to absorb mechanical or thermal changes in length, in particular of the elements to be supported, without distortion of the bearing assemblies.

Since—owing to mechanical constraints—the (driving) torque can no longer be transmitted directly via a drive journal arranged on the (end of the) roll in the case of such rolls of small diameter, such rolls are driven exclusively by intermediate rolls that are arranged parallel to the rolls (in respect of their respective axes of rotation) and are in nonpositive or frictional contact via their respective lateral surfaces/surfaces with the rolls (to be driven)—(and are mounted in such a way as to be rotatable about their own respective axes of rotation).

In general, these rolls are also supported laterally—in relation to the direction of strip running—that is to say at their (two) axial end faces—by further supporting rolls or supporting rollers (likewise mounted in such a way as to be rotatable about their own axes of rotation), by nonpositive engagement or frictional engagement (the roll and the supporting roll/roller or the lateral surfaces/surfaces roll on one another).

That is to say that, in the axial direction of the rolls, the positive/frictional engagement between said rolls—which effects the lateral support (at the axial ends of the rolls)—is obtained by means of rollers in the form of supporting rolls or supporting rollers mounted laterally (on both sides) and oriented in the vertical direction. That is to say that the axes of rotation of these supporting rollers are aligned normally to the axes of rotation of the rolls to be supported by them, or vertically (in the case of horizontally aligned rolls).

A supporting roller of this kind—supporting the roll axially—provides a running surface/lateral surface/surface ("barrel shape") which is curved—(also) in the axial direction (in respect of its axis of rotation)—and the largest-diameter circumferential circle of which is offset radially in relation to the axis of rotation of the roll (circumferential circles or circumferential circle areas are obtained by means of sections through the supporting roller normal to the axis of rotation thereof).

As a result, these lateral supporting rollers or supporting rollers arranged axially on the ends of the rolls (on both sides) each roll along a line on their surface (i.e. the circumferential circle forming the linear nonpositive or frictional contact with/on the end of the roll) on the respective axial end faces of the roll—and thus limit the movement thereof in the axial direction.

The roll may have mechanical play in the axial direction, and therefore the two supporting rollers on both sides are not necessarily always contacted simultaneously, the roll instead "floating freely" between them.

Thus, such "free-floating" rolls are held—non-positively by way of the respective contact made—by the intermediate rolls, the supporting rolls/rollers and the rolling stock. While the rolls are being exchanged, the roll stand is opened, and the rolls are supported by "balancing arms".

In practice, it has been found that it is precisely this type of lateral or axial support of the roll by the supporting rollers that can cause major problems.

Because of high roll (rotational) speeds (due to the small diameter of the rolls) and large applied rolling forces (because of the relatively high-strength or high-strength rolling stock to be rolled) and owing to wear phenomena (at the nonpositive/frictional contact) of participating surfaces/lateral surfaces (the touching/contacting surfaces/lateral surfaces suffer mechanical wear), there are namely repeated frictional processes between these lateral supporting rollers and the end of the roll at that location—instead of a clean rolling movement along a line of contact ("linear contact", circumferential circle).

By their very nature, these frictional processes also generate a large amount of frictional heat—and, in the worst case, lead even to ignition and burning down of the roll stand (there is rolling oil throughout the interior region of the roll stand, and this is combustible at very high temperatures).

It is an object of the invention to make available a roll stand having at least one working roll mounted therein, which has improved frictional and wear behavior and is of structurally simple design.

SUMMARY OF THE INVENTION

According to the invention, this object is achieved by means of a roll stand. Advantageous developments of the invention form the subject matter of the following description.

The roll stand according to the invention, which has a working roll (referred to below just as a roll for short), which is mounted in the roll stand in a floating manner and in such a way to be rotatable about an axially extending axis of rotation and which has two axially opposite ends, provides at least one bearing module, which is arranged on one of the two ends of the working roll and has a casing, in which the working roll is mounted using a fixed bearing assembly.

Using the bearing module, the roll is then mounted in a floating manner in the roll stand. That is to say, expressed briefly and in simplified form, that the bearing module which supports the roll by means of the fixed bearing assembly is accommodated in a "floating" manner in the roll stand.

In relation to the axis of rotation of the roll, "axial" or "axial direction" may be understood to mean the "longitudinal extent" or "direction of longitudinal extent" thereof. "Radial" or "radial direction" is therefore the extent oriented normally to "axial" or the "axial direction".

In particular, a bearing module of this kind, in the casing of which the roll is accommodated by means of the fixed bearing assembly, can also be arranged at either of the two ends of the roll.

Here, a fixed bearing assembly can be taken to mean a bearing concept or bearing assembly/bearing arrangement (for supporting a component, such as the roll, rotating about an axially extending axis of rotation) which positions the component to be supported, or roll, in a definite manner in the axial direction (in relation to the axis of rotation).

A fixed bearing assembly of this kind will therefore absorb both radial forces and axial forces (axial forces in both axial directions) and direct them into a structure, such as a casing or the casing of the bearing module, "surrounding" the component to be supported, or roll.

In principle, this fixed bearing assembly can be provided by a single bearing, e.g. a rolling bearing (or optionally also a sliding bearing), (here, both the axial forces and the radial forces are absorbed by this single bearing, e.g. a deep-groove ball bearing or a four-point bearing, each with outer and inner rings arranged immovably).

In the case of very high axial or radial loads, two bearings, e.g. two rolling bearings (or optionally also two sliding bearings) are often used to perform the fixed bearing function, e.g. a preloaded (rolling) bearing assembly (here, two fixed bearings are clamped against one another, e.g. two angular contact ball bearings or taper roller bearings arranged mirror-image fashion) or a fixed-floating bearing assembly (here, the axial and radial forces are split between two bearings, i.e. an axial bearing that exclusively absorbs the axial forces and a radial bearing that exclusively absorbs the radial forces, e.g. a cylindrical roller bearing (for the radial forces) with an axial roller bearing (for the axial forces)).

If the fixed bearing support is provided by means of rolling bearings, they can be grease-lubricated or oil-lubricated, in particular grease-lubricated, to reduce friction and wear there.

Here, "supported in a floating manner" means, in particular, that the supported component, in this case the roll (in the roll stand) is not fixed in a definite manner or firmly in its position (i.e. is supported "in a floating manner" (or in a translationally movable manner) and is "only" supported via the bearing module, whereby the roll or structural unit comprising the roll and the bearing module is then accommodated in this way in the roll stand) but that (translational) degrees of freedom (for the roll) are possible, which allow a (translational) change in the position of the roll in the roll stand, e.g. axial and/or horizontal mobility of the roll.

It is thereby possible to absorb mechanical or thermal changes in length, in particular at the roll and/or the bearing module, without distortion of the bearing assembly or the roll.

If there is vertical support of the bearing module in the roll stand in this way, for example, horizontal mobility of the roll in the roll stand can thereby be ensured. By means of telescopic mobility—in the axial direction—of two components relative to one another, axial mobility of the roll can be achieved, if namely the components are arranged—in the axial direction—between the bearing module and the roll stand or a roll housing at that location.

The invention is based on the consideration and realization that, in supporting the roll by means of the previous supporting roller that rolls on the rotating roll, both a "(static) supporting function" (in this case, the roll is supported axially) and simultaneously a "freedom of movement function" (in this case, the rotary motion or rotational degree of freedom of the roll is made possible by a dynamic rolling movement between the roll and the supporting roller) are combined in a single component, i.e./namely the supporting roller, owing to the fact that the supporting roller rolls on the rotating roll.

If a (single) component, that is to say, in this case, the supporting roller, combines these two—essentially different—functions, i.e. the "static supporting function" and the "freedom of movement function", this (single) component is subject to extremely different loads if it is to perform both functions. However, this high loading is the cause of the problems with wear (and the following problems that then ensue) on the supporting roller.

Implementing this consideration or realization, the invention provides a—"structural and functional"—division or separation between these two functions, i.e. the "static supporting function" and the "freedom of movement function".

Thus, the "freedom of movement function" is implemented by the working roll being mounted/accommodated—by means of a fixed bearing assembly—in the bearing module or the casing thereof. The rotational degree of freedom is made possible—exclusively—by the fixed bearing assembly, as a result of which—with a "fixed" (i.e. non-rotating) casing or bearing module—the roll rotates relative to the "fixed" casing or bearing module.

Once the roll is accommodated in the bearing module or the casing thereof by means of the fixed bearing assembly, the "static supporting function" (for the roll) can then be implemented by supporting or accommodating the casing or bearing module "in a floating manner" in the roll stand, e.g. in a roll housing at that location. Thus, rotary relative motion does not occur (any longer) between such a "fixed" roll housing and the "fixed" casing or bearing module (whereas translational movements (because of the "floating" support) are possible).

Expressed in simplified terms, the "static support" takes place between the bearing module/casing and the roll stand; the "rotation/rotational degree of freedom" is accomplished by means of the fixed bearing assembly between the roll and the casing/bearing module. In brief, "support" and "rotation/the rotational degree of freedom" are decoupled.

A roll stand in which the working roll is supported in a floating manner at one end by means of a bearing module of the type described above is disclosed in WO 2005/011885 A1 and JP H10 80708 A, for example.

In the case of the invention, it is furthermore envisaged that the bearing module has a supporting device, by means of which the bearing module can be supported axially in the roll stand.

The supporting device of the bearing module makes it possible to dissipate axial forces that act on the working roll during the operation of the roll stand to the roll stand, in particular to a roll housing of the roll stand. Reliable and stable operation of the roll stand is thereby made possible.

In other words, it is possible, in the invention, not only to implement the "floating" mounting/support of the roll but also to implement dissipation of axial forces to the roll stand, in particular to a roll housing of the roll stand, with the aid of the bearing module.

In contrast to the situation with the roll stand from WO 2005/011885 A1 or JP H10 80708 A, in which the bearing module does not have a supporting device for the axial support of the bearing module (and thus also of the roll), no separate module (in addition to the bearing module) that can dissipate axial forces to the roll stand, in particular to the roll housing thereof, is required in the invention. A roll stand configuration of simple design is thereby made possible.

In the case of the roll stand from WO 2005/011885 A1 or JP H10 80708 A, axial forces are dissipated to the roll stand or roll housing via an axial adjusting means arranged opposite the bearing module. In the case of the invention, it is possible in principle to dispense with an axial adjusting means of this kind.

According to a preferred development, it is envisaged that the fixed bearing assembly is implemented using a rolling bearing arrangement, in particular a preloaded rolling bearing arrangement.

The rolling bearing arrangement forming the fixed bearing assembly can be implemented by means of a single (rolling) bearing but especially—indeed of necessity in the case of a preloaded (rolling) bearing assembly—by means of two (or optionally even more) (rolling) bearings.

If, in a development, a preloaded rolling bearing arrangement is provided, the preloading of the rolling bearing arrangement can be implemented in the form of an X arrangement or an O arrangement. To enlarge a width of support, it may be expedient for the preloading to be an O arrangement.

As a development, provision can furthermore also be made for the rolling bearing arrangement, in particular the preloaded rolling bearing arrangement, to be implemented using at least one first and at least one second taper roller bearing or spherical roller bearing or angular contact ball bearing preloaded against one another.

As a particular preference, it is possible in this way to use a first and a second taper roller bearing preloaded against one another in an O arrangement.

In order to reduce the loading on a single (rolling) bearing, in particular a single one of the (rolling) bearings preloaded relative to one another, provision can be made to use a plurality of the first and/or second (rolling) bearings, in particular taper roller bearings.

According to another development, it is envisaged that the bearing module, in particular the casing, is sealed off and/or enclosed with respect to an environment, in particular using one or more seals, in particular a radial shaft seal and/or a V-ring seal and/or an O-ring seal and/or a labyrinth seal. In this way, the fixed bearing assembly or the interior of the casing can be protected from environmental stresses, such as dirt, dust and the like, and thus its life increased.

According to a preferred development, it is envisaged that the supporting device is arranged on the casing of the bearing module. By means of the supporting device, the casing—and thus the roll—can be supported axially in the roll stand, e.g. on a roll housing.

In order to implement as far as possible defined axial support of the bearing module (and thus of the roll), it is expedient if the supporting device has a cambered end face for axial support, e.g. against a flat plate in the roll stand ("casing stopper"). By means of the cambering on the end face of the supporting device, the supporting contact can—ideally—be reduced to point contact, which is free from radial obstacles/restrictions.

The bearing module preferably comprises a spring element, in particular a helical spring. Moreover, it is advantageous if the supporting device has a first and a second component. It is furthermore possible, as a development, to envisage that the two components of the supporting device are movable relative to one another in the axial direction (similarly to a telescope) (and in this way the (axially) floating support of the roll is implemented). In this way, it is possible to absorb mechanical or thermal changes in length, in particular of the roll, without the occurrence of jamming and the like. It is advantageous if the two components of the supporting device can be clamped in the axial direction using the spring element.

The first component can be of integral design with part of the casing, in particular a casing cover, of the bearing module, for example. In a preferred manner, the first component is designed as a hollow cylinder open at one end. At its open end, this advantageously has a radially projecting rim. It is furthermore preferred if the second component is designed as a hollow cylinder open at one end. With its inner extent, said component advantageously fits around the rim of the first component.

Furthermore, provision can be made for an annular washer, the inside diameter of which is smaller than the diameter of the rim of the first component, to be secured on a radially outer end face of the second component facing the working roll.

Said spring element is advantageously arranged in a cavity of the first component. By its first end, the spring element is preferably supported against the casing of the bearing module. By its second end, the spring element is preferably supported against a radially inner end face of the second component facing the working roll.

According to a development, it is envisaged that the fixed bearing assembly has a substantially axially extending roll extension, which is arranged on one of the two ends of the roll, on which the fixed bearing assembly "is seated", i.e. on which bearings of the fixed bearing assembly, e.g. the (preloaded) taper roller bearings, in particular in the configuration with a plurality of first and/or second rolling or taper roller bearings, are arranged.

As a development, particularly in the case of the plurality of first and/or second rolling or taper roller bearings, provision can preferably also be made for inner rings of the rolling bearings, in particular taper roller bearings, forming the fixed bearing assembly, to be clamped on the roll extension, in particular using distance rings arranged between the inner rings on the roll extension and/or using a shaft nut.

Distance rings of this kind can also be provided in the case of the outer rings, i.e. between the outer rings, of the rolling bearings, in particular taper roller bearings, forming the fixed bearing assembly, particularly in the case of the plurality of first and/or second rolling or taper roller bearings.

By means of such distance rings—which are, in particular, precision-manufactured—it is possible, precisely in the case of the plurality of first and second rolling or taper roller bearings, to optimize force distribution between the rolling bearings or taper roller bearings.

In particular by matching the "inner" and "outer" distance rings, it is possible to dissipate supporting forces into the casing—in a manner which involves uniform distribution between the outer rings of the rolling bearings, in particular taper roller bearings.

The clamping can preferably be implemented by means of offsets, shoulders and the like on the roll extension, against which the inner rings of the rolling bearings, in particular taper roller bearings, forming the fixed bearing assembly can be clamped. For this purpose, the shaft nut can be screwed onto the "free end" of the shaft extension.

It is expedient if the roll extension is screwed, in particular screwed in a centered manner to the roll or formed integrally with the roll (at the opposite end of the extension from the free end). Precisely in the case of a roll extension that can be screwed to the roll, easy (flexible and quick and therefore less expensive and less time-consuming) exchange of a roll is possible, thus, for example, when the roll is worn or the roll nip has changed, without further disassembly, in particular of the bearing module, being necessary.

If the roll is hardened all the way through, as is preferable, provision can be made for the roll extension not to be hardened.

According to another preferred development, provision is made for the bearing module, in particular the casing, to have at least one holding element ("ear lobe") with a supporting surface for a movable support ("floating support") on a carrying element, in particular a bending cylinder. Two such holding elements can preferably be provided on the casing.

If, in this way—when there is a change of roll—the roll is supported via the holding element or elements—after lateral opening of the roll stand—by/on the carrying element/s or bending cylinder/s—and if the roll can then subsequently be removed from the roll stand by an appropriate device (slide or the like), this makes it possible to dispense with the known "balancing arms".

In order to facilitate an assembly/disassembly action on the roll stand, one expedient possibility is for the casing to be of multi-part construction, in particular being formed from two covers ("inner/outer cover") and an intermediate piece ("chock") accommodated between the two covers.

The holding element/holding elements is/are then preferably arranged on this intermediate piece, e.g. being screwed on and formed integrally with the intermediate piece.

According to another development, it is envisaged that the roll has a diameter in a range of from about 150 mm to about 200 mm, in particular in a range of from about 150 mm to about 180 mm, especially about 180 mm.

Moreover, provision can preferably also be made for the roll stand to have two of the bearing modules. It is advantageous if one of the two bearing modules is arranged on one of the two ends of the working roll, and if the other of the two bearing modules is arranged on the other of the two ends of the working roll, thereby in this way enabling the roll to be supported (in a floating manner) at both ends in the roll stand.

The description given hitherto of advantageous embodiments of the invention contains numerous features which are in some cases reproduced together in groups. However, these features can expediently also be considered individually and combined into other meaningful combinations. In particular, these features can be combined individually and in any suitable combination with the roll stand according to the invention.

Even if some terms are in each case used in the singular or in combination with a quantifier in the description and/or in the patent claims, there is no intention to restrict the scope of the invention to the singular or the respective quantifier in respect of these terms. Moreover, the words "a" and "an" should not be interpreted as quantifiers but as indefinite articles.

The above-described properties, features and advantages of the invention and the manner in which these are achieved will become more clearly and distinctly comprehensible in conjunction with the following description of the illustrative embodiment/s of the invention, which is/are explained in greater detail in conjunction with the drawings. The illustrative embodiment/s serve/s to explain the invention and do not restrict the invention to the combinations of features, including functional features, indicated therein. In addition, suitable features of any illustrative embodiment can furthermore also be explicitly considered in isolation, removed from an illustrative embodiment, introduced into some other illustrative embodiment to supplement the latter, and combined with any of the claims.

DETAILED DESCRIPTION

Figure 1:
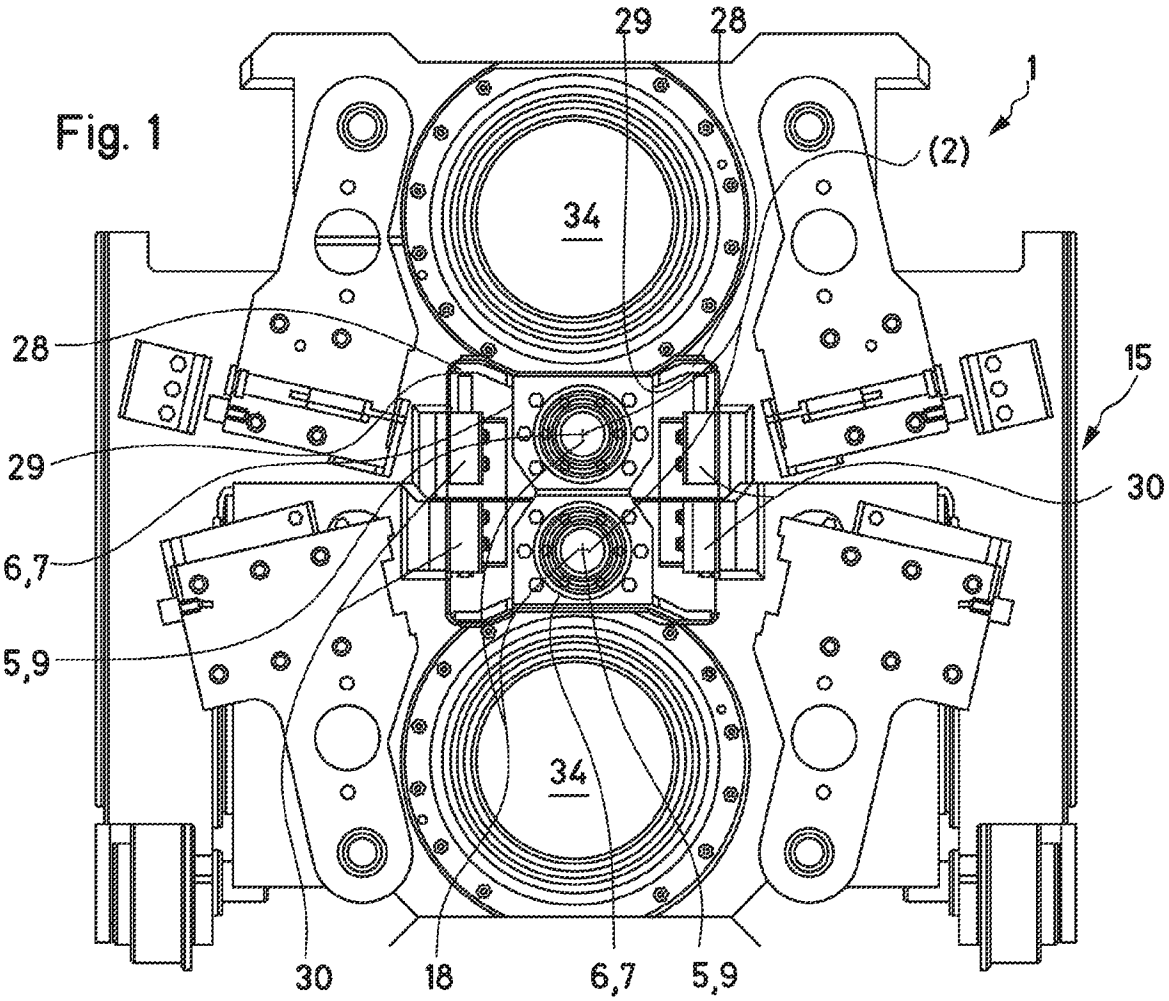
FIG. 1 shows schematically a structure of a roll stand having two working rolls mounted therein.

FIG. 1 shows schematically a structure of a roll stand 1 having—two—working rolls 2 mounted (in a floating manner)—at that location—in such a way as to be rotatable about their respective axially extending axis of rotation 9, for shaping, i.e. rolling, rolling stock, in this case high-strength steel.

Here, the two working rolls 2, which each have a diameter of about 180 mm, are arranged parallel to one another (in respect of their axes of rotation)—at a pre-adjustable or adjustable spacing—in the roll stand 1 (substantially vertically one above the other), thereby forming a roll nip between the two working rolls 2, through which the rolling stock passes and is deformed, i.e. rolled, as it does so.

Since the (driving) torque can no longer be transmitted directly via drive journals arranged on the (axial ends of the) rolls in the case of such rolls of small diameter, the two working rolls 2 are driven, as FIG. 1 shows, by means of intermediate rolls 34 that are arranged parallel to the working rolls 2 (in respect of their respective axes of rotation 9) and are in nonpositive or frictional contact via their respective lateral surfaces/surfaces with the working rolls 2 (to be driven).

The two working rolls 2 (referred to for short just as rolls 2 below) are of substantially identical construction and, as FIG. 1 shows, have only slight differences in respect of their installation environment in accordance with their arrangement as "upper" and "lower" rolls 2. However, the functional structural elements on both rolls 2 are fundamentally identical.

Figure 2:
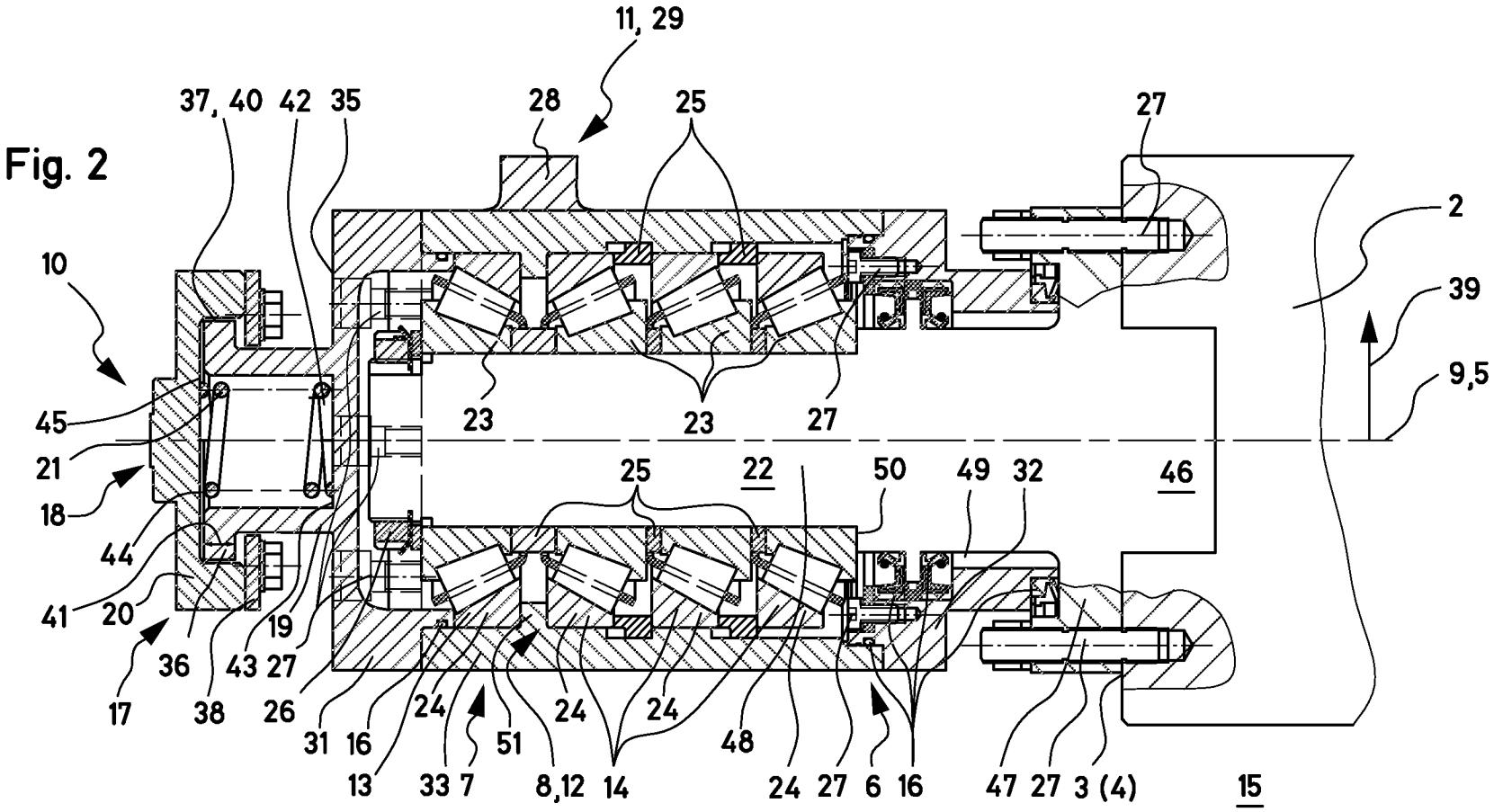
FIG. 2 shows part of a working roll with a bearing module (illustrated in section)
Figure 3:
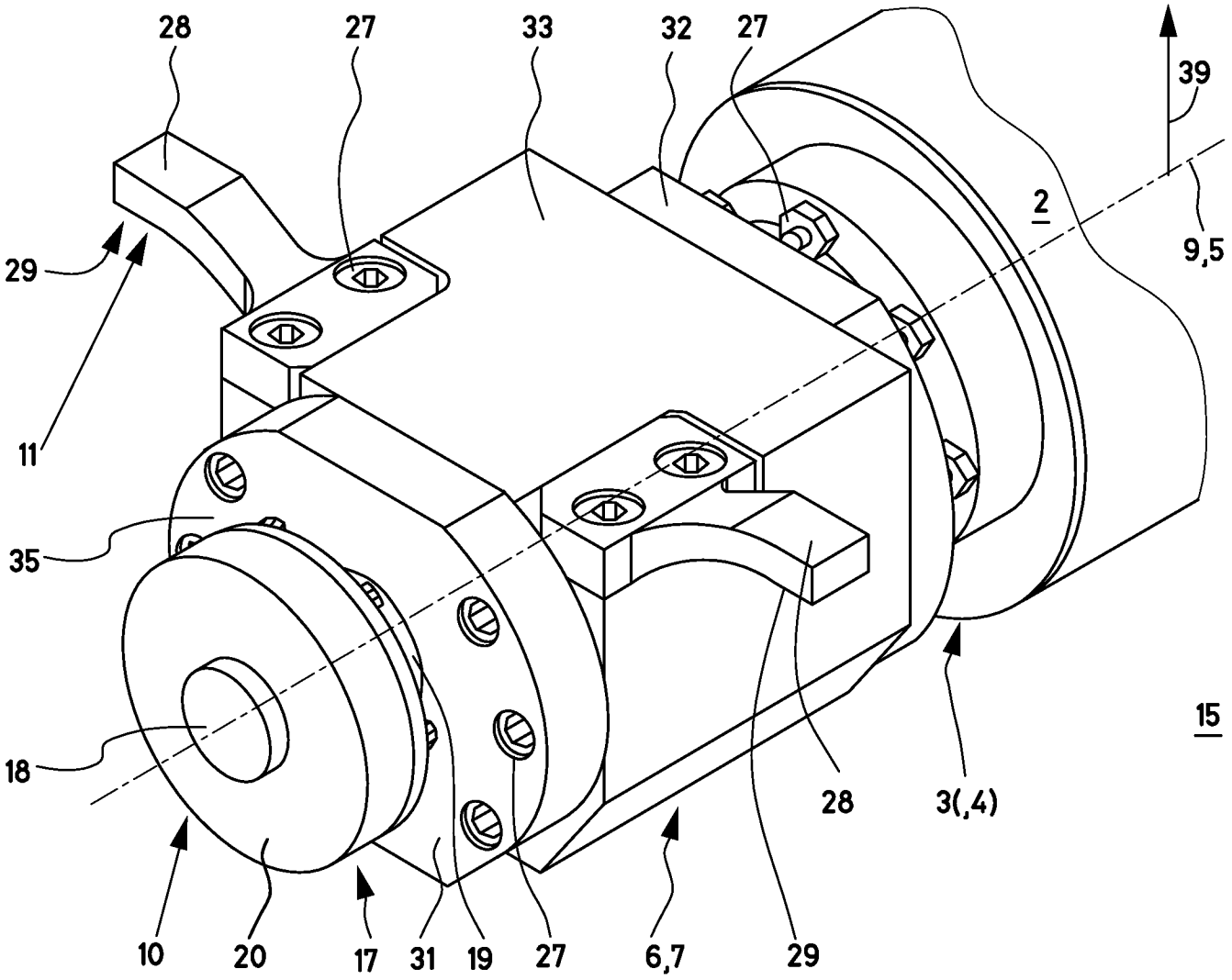
FIG. 3 shows part of a working roll with a bearing module (in perspective).

FIG. 2 and FIG. 3 each show part of the roll 2—with the bearing module 6 thereof arranged on the (axial) end 3 (or 4) of the roll 2, using which module the roll 2 is mounted or accommodated (in a floating manner) in the roll stand 1.

A second (symmetrically identical) bearing module 6 is arranged (but not illustrated) on the other (axial) end 4 (or 3) (not visible) of the roll 2—in a manner corresponding to the first bearing module 6.

As FIG. 2 and FIG. 3 show, the bearing module 6 provides a—sealed or enclosed—(multi-part and screw fastenable/fastened) casing 7, in which the roll 2 is—rotatably—accommodated/mounted by means of a fixed bearing assembly 8 at that location in a manner positioned precisely in the axial direction 5 and in the radial direction 39.

The casing 7 (and thus the roll 2), in turn, is supported in the roll stand 1 or on a roll housing (not illustrated) via its end 35 remote from the roll 2 by means of a supporting device 17 ("casing stopper") arranged at that end.

In order to reduce the supporting contact (between the supporting device 17 and the roll housing)—ideally—two point contact, the supporting device 17, as FIG. 2 and FIG. 3 illustrate, has an axial, cambered end face 18 for axially supporting 10 the roll 2/the bearing module 6 or the casing 7 on the roll housing.

As FIG. 2 shows, the supporting device 17 or "casing stopper" has two components 19, 20 that can be moved in the axial direction 5 relative to one another (and in this way/thereby implements axially movable or axially floating mounting/support 10 of the roll 2 in the roll stand 1), which two components 19, 20 can be clamped in the axial direction 5 using a spring element 21, in this case a helical spring 21, (thereby enabling the roll 2 to be clamped or clamped in axially in the roll stand 1). In this way, it is possible to absorb mechanical or thermal changes in length, in particular of the roll 2, without the occurrence of jamming and the like. Even displacements—caused by the interaction that occurs during rolling itself between the roll 2 with the intermediate rolls 34 and the rolling stock—can thereby be absorbed.

As FIG. 3 shows, the supporting device 17 has a first, flange-like, axially extending component 19, which is formed integrally with/on an—axially outer (i.e. facing away in the axial direction 5 of the roll 2; "inner" and "outer" understood to be in the axial direction 5 in relation to the roll 2)—casing cover 31 of the casing 7.

This first component 19 of the supporting device 17 is similar to a hollow cylinder open at one end, which has a radially projecting rim 36 (similar to a flange) at its axially open (axially outer) end.

As FIG. 2 illustrates, the second component 20 of the supporting device 17, which is likewise of substantially cylindrical design and the axially outer end 18 of which provides or forms the cambered surface 18 of the supporting device 17 (for axial support in the roll stand 1 or against the roll housing) fits around the rim 36 of the first component 19 from the outside on or with its inner extent 37—by means of a (screwed-on) annular washer 38.

Within the area in which it fits around the rim, the second component 20, as FIG. 2 shows, makes available an axial movement path 40 on which the first component 19 or the radial rim 36 thereof can be moved ("in an axially floating manner") axially relative to the second component 20.

If the axial thickness 41 of the radial rim 36 of the first component 19 is about 7 mm with an envisaged movement path 40 of about 12 mm, a free axial mobility of the first component 19 relative to the second component 20 of approximately 5 mm is obtained.

As FIG. 2 also shows, in order to be able to clamp the first component 19 of the supporting device 17 against the second component 20 of the supporting device 17 and, at the same time, to be able to compensate length changes, the helical spring 21 is provided, which is arranged within the hollow cylindrical part, open at one end, of the first component 19 and the first (axially inner) end 42 of which is supported against the axially outer end 43 of the outer casing cover 31 and the second (axially outer) end 44 of which is supported against the (axially inner) end face 45 of the second component 20.

As FIG. 2 and FIG. 3 show, the casing 7 has three casing parts 31, 32, 33, namely the abovementioned axially outer casing cover 31, an axially inner casing cover 32 and an intermediate piece 33 arranged (axially) between the axially outer 31 and the axially inner casing cover 32.

The three casing parts 31, 32, 33 are screw to one another—by means of a plurality of stud bolts 27—and are sealed off by means of sealing elements 16 (at the joints), in this case using rubber sealing rings 16.

As FIGS. 1 to 3 also show, the casing 7 (and thus the roll 2) is provided with further—vertical or vertically movable/floating—support 11 in the roll stand 1 by means of two holding arms 28 ("ear lobes") (cf. especially FIG. 3), which are screwed to the casing 7 or intermediate piece 33, which holding arms 28, as FIG. 1 shows, rest by means of supporting surfaces 29 on bending cylinders 30 or cylinder rods thereof arranged in the roll stand 1 (thus making the bearing module 6/the casing 7 and the roll 2 horizontally (translationally) movable ("floating") (which (also) allows the roll 2 a certain freedom of movement in the direction of strip running).

The—vertical or vertically floating—support 11 of the roll 2 on the bending cylinders 30 also makes it possible to dispense with the previous "balancing arms".

As FIG. 2, the roll 2 is mounted in the bearing module 6 or in the casing 7 by means of a roll extension 22, which is screwed at the (axial) end onto the (axial) roll end 3 (or 4)—being centered by means of a centering journal 46—by means of stud bolts 27 via a flange 47 formed on the roll extension 22.

Via an opening 49 formed in the inner casing cover 32, the roll extension 22 or the axially free end 48 thereof then enters the casing 7, where it is rotatably mounted by means of a fixed bearing assembly 8.

By means of seals 16, in this case a plurality of radial shaft seals or shaft sealing rings 16 (in radial and axial configurations and arrangements), the casing 7, i.e. the axially inner casing cover 32 is, as FIG. 3 shows, sealed off with respect to the roll extension 22 or the free end 48 thereof (from the environment 15, i.e. moisture, rolling oil, dust and the like), with the result that a fully enclosed "bearing casing" 7 for the bearing module 6 is formed.

As FIG. 2 shows, (a (preloaded) rolling bearing arrangement 12 comprising) four taper roller bearings 13, 14 (is) are arranged on this roll extension 22 (within the sealed/enclosed casing 7), wherein the two taper roller bearings 13, 14 that are—axially—outermost or situated axially furthest out are arranged in an O arrangement. The two other (axially inner) taper roller bearings 14 are arranged/aligned in a manner corresponding to their—axially—outer neighbors 14.

As FIG. 2 also shows, the taper roller bearings 13, 14, i.e. the inner rings 23 thereof, are pressed against a (radial) offset 50 on the roll extension 22 by means of a shaft nut 26.

Precision-manufactured spacer/distance rings 25—for optimized (i.e. uniformly distributed) force distribution to the individual bearings—are arranged between the inner rings 23 of the taper roller bearings 13, 14.

Precision-manufactured spacer/distance rings 25—for optimized (i.e. uniformly distributed) force distribution to the individual bearings—are likewise arranged between the outer rings 24 of the three axially inner taper roller bearings 14 forming a supporting direction.

The outer ring 24 of the axially outermost taper roller bearing 14 of these three axially inner taper roller bearings 14 forming a supporting device rests—axially on the inside—against a radially inward-extending offset (shoulder) 51 on the casing intermediate piece 33; the outer ring 24 of the axially outermost taper roller bearing 13 rests—space axially on the outside—against the radially inward-extending offset 51 on the casing intermediate piece 33 and is held by means of the axially outer casing cover 31.

By virtue of the matching of the "inner" and "outer" precision-manufactured spacer/distance rings 25, supporting forces are dissipated into the casing 7 via the radially inward-extending offset (shoulder) 51—in a manner uniformly distributed over the outer rings 24 of the taper roller bearings 14.

By virtue of the vertical/vertically floating support 11 of the bearing module 6, by means of the holding arms 28 thereof, in the roll stand 1, or by virtue of this horizontal (translational) mobility of the bearing module 6 or roll 2 and of the axial mobility of the bearing module 6 or roll 2 by means of the supporting device 17 relative to the roll stand 1 or roll housing, on the one hand, and the fixed bearing assembly 8 of the roll 2 and the bearing module 6, the "support" and the "rotation/rotational degree of freedom" are decoupled at the roll 2, and this has a wear-reducing effect on the mounting of the roll 2.

With this mounting of the roll 2 by means of this bearing module 6, the roll 2 is held in the roll stand 1 by the bending cylinders 30 via the holding arms 28 on the casing 7 of the bearing module 6—even after the lateral opening of the roll stand 1—when there is a change of roll, and can subsequently be removed by an appropriate device (slide or the like), thereby significantly simplifying roll exchange.

If the roll extension 22 is "only" screwed to the roll 2, it can be screwed to the next roll 2 that is ready for use "immediately"—after the removal of the roll 2 from the roll stand 1—while the "used" roll 2 can be taken for reconditioning.

As a result, it is advantageously only necessary to exchange the actual worn part (namely the roll 2 itself), while the roll extension 22 can be immediately screwed to the next roll 2 that is ready for use, and the arrangement comprising the roll 2, the roll extension 22 and the bearing module 6 can be reinstalled in the roll stand 1.

Moreover, the roll extension 22 can be screwed to rolls 2 of different diameters and is "continuously in use". That is to say, only the number of roll extensions 22 that is actually required in the roll stands 1 (plus one possibly in reserve) need be procured, while a relatively large number of rolls 2 (e.g. of different diameters for different rolling requirements and matched to the expected time required for adaptation work after exchange) can be held ready.

Moreover, the bearing module 6 or the mounting of the roll 2 implemented in this regard furthermore offers an additional advantage when threading a new piece of rolling stock into the roll stand 1. During this process, namely, the "upper" and "lower" roll 2 must, on the one hand, be moved apart in order to avoid a mechanical shock due to the end of the new piece of rolling stock (risk of damage). This moving apart of the rolls 2 is supported by the bending cylinders 30, which raise the "upper" roll 2 in an appropriate manner and lower the "lower" roll 2 in an appropriate manner by way of their holding arms.

In addition—and in contrast to previous overhung working rolls—the rolls 2 can be pressed against the intermediate rolls 34 (driving the rolls 2) by the bending cylinders 30, with the result that they are accelerated by these to the rolling stock speed, thus ensuring that, during the subsequent moving together of the roll nip to the setpoint rolling thickness, correspondingly gentle and roll-sparing contacting of the rolls 2 with the rolling stock occurs.

If the casing 7 of the bearing module 6 is enclosed and sealed off—and thus the inner fixed bearing assembly 8 protected from external influences, the life of the bearing elements is thereby increased many times over.

Although the invention has been illustrated and described more specifically in detail by means of the preferred illustrative embodiment/s, the invention is not restricted by the example/s disclosed, and other variations can be derived therefrom without exceeding the scope of protection of the invention.

LIST OF REFERENCE SIGNS

1 rolling stand
2 working roll, roll
3 (axial) end of 2
4 (axial) end of 2
5 axial direction
6 bearing module
7 (sealed and enclosed) (bearing) casing
8 fixed bearing assembly
9 axis of rotation
10 (axial) floating mounting/(axial) support
11 (vertical) floating mounting/(vertical) support
12 (preloaded) rolling bearing arrangement, bearing
13 (first) taper roller bearing(s)
14 (second) taper roller bearing(s)
15 environment
16 seal/sealing element, radial shaft seal, V-ring seal, O-ring seal, labyrinth seal
17 supporting device
18 axial, cambered end face of 17, axially outer end of 20
19 first component of 17
20 second component of 17
21 spring element, helical spring
22 roll extension
23 inner ring (of 12, 13 and 14)
24 outer ring (of 12, 13 and 14)
25 precision-manufactured spacer/distance ring
26 shaft nut
27 (centered) screw fastening, (stud) bolt
28 holding element/arm ("ear lobe")
29 supporting surface
30 carrying element, bending cylinder
31 (axially outer) casing cover
32 (axially inner) casing cover
33 intermediate piece
34 intermediate roll
35 (axial) end of 7
36 (radially projecting) rim of 19, flange
37 inner extent of 20
38 annular washer
39 radial direction
40 axial movement path
41 axial thickness of 36
42 first (axially inner) end of 21

43 axially outer end of 31
44 second (axially outer) end of 21
45 axially inner end face of 20
46 centering journal
47 flange on 22
48 axially free end of 22
49 opening in 32
50 (radial) offset on 22
51 radially inward-extending offset on 33

The invention claimed is:

1. A roll stand, comprising:

a working roll mounted in a floating manner and rotatable about an axially extending axis of rotation and which has two axially opposite end faces; and at least one bearing module arranged on one of the two end faces of the working roll and supporting the working roll in a floating manner, the at least one bearing module having a casing in which the working roll is mounted using a fixed bearing assembly, the bearing module comprising a spring element;

wherein a supporting device supports the at least one bearing module axially in the roll stand and includes a first component and a second component, the two components being movable relative to one another in an axial direction and being clampable in the axial direction using the spring element;

wherein the first component is a hollow cylinder open at one end, and has a radially projecting rim at the open end; and wherein the second component is a hollow cylinder open at one end, an inner extent of the second component adapted to fit around the rim of the first component.

2. The roll stand according to claim 1, wherein the fixed bearing assembly is implemented using a rolling bearing arrangement.

3. The roll stand according to claim 2, wherein the rolling bearing arrangement is a preloaded rolling bearing arrangement.

4. The roll stand according to claim 1, wherein the bearing module is sealed off with respect to an environment by using at least one of a radial shaft seal, a V-ring seal, an O-ring seal, and a labyrinth seal.

5. The roll stand according to claim 1, wherein:

the supporting device is arranged on the casing of the bearing module; and the casing is adapted to be supported axially by the supporting device.

6. The roll stand according to claim 1, wherein the supporting device has a cambered end face for axial support.

7. The roll stand according to claim 1, wherein an annular washer, an inside diameter of the annular washer being smaller than a diameter of the rim of the first component, is secured on a radially outer end face of the second component facing the working roll.

8. The roll stand according to claim 1, wherein the spring element is supported by its first end against the casing of the bearing module and by its second end against a radially inner end face of the second component facing the working roll.

9. The roll stand according to claim 1, wherein the fixed bearing assembly has a substantially axially extending roll extension, which is arranged on one of the two ends of the working roll and on which bearings of the fixed bearing assembly are arranged.

10. The roll stand according to claim 9, wherein inner rings of the bearings are clamped on the roll extension.

11. The roll stand according to claim 10, wherein the inner rings of the bearings are clamped on the roll extension using at least one of distance rings arranged between the inner rings on the roll extension and a shaft nut.

12. The roll stand according to claim 9, wherein the roll extension is one of screwed to the working roll and formed integrally with the working roll.

13. The roll stand according to claim 1, wherein the casing has at least one holding element with a supporting surface for a movable support on a carrying element.

14. The roll stand according to claim 1, wherein the casing is of multi-part construction.

15. The roll stand according to claim 14, wherein the casing is formed from two covers and an intermediate piece accommodated between the two covers.

16. The roll stand according to claim 1, wherein:

the at least one bearing module is two bearing modules;

one of the two bearing modules is arranged on one of the two ends of the working roll; and the other of the two bearing modules is arranged on the other of the two ends of the working roll.

17. The roll stand according to claim 13, wherein the at least one holding element comprises lobes.

18. The roll stand according to claim 13, wherein the at least one holding element comprises arms.

* * * * *